US011491783B2

(12) United States Patent
Watanabe et al.

(10) Patent No.: US 11,491,783 B2
(45) Date of Patent: Nov. 8, 2022

(54) INKJET RECORDING APPARATUS

(71) Applicant: KYOCERA Document Solutions Inc., Osaka (JP)

(72) Inventors: Takeshi Watanabe, Osaka (JP); Hiroyuki Ueda, Osaka (JP); Hiroatsu Tamai, Osaka (JP); Takatoshi Nishimura, Osaka (JP); Noriaki Ozawa, Osaka (JP); Toyotsune Inoue, Osaka (JP); Susumu Hiroshima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/182,014

(22) Filed: Feb. 22, 2021

(65) Prior Publication Data

US 2021/0170745 A1 Jun. 10, 2021

Related U.S. Application Data

(63) Continuation of application No. 16/346,802, filed as application No. PCT/JP2018/018894 on May 16, 2018, now Pat. No. 10,960,664.

(30) Foreign Application Priority Data

Jun. 28, 2017 (JP) ..... 2017-126003

(51) Int. Cl.
*B41J 29/38* (2006.01)
*B41J 2/045* (2006.01)
(Continued)

(52) U.S. Cl.
CPC ..... *B41J 2/04558* (2013.01); *B41J 2/04586* (2013.01); *B41J 3/60* (2013.01); *B41J 11/0005* (2013.01); *B65H 29/70* (2013.01)

(58) Field of Classification Search
None
See application file for complete search history.

(56) References Cited

U.S. PATENT DOCUMENTS 7,775,619 B2 8/2010 Kawabata
9,022,508 B2 5/2015 Ue et al.
(Continued)

FOREIGN PATENT DOCUMENTS

CN 102555454 B * 4/2015 ..... B41J 11/0005
EP 2471667 A1 7/2012
(Continued)

OTHER PUBLICATIONS

The extended European search report issued by the European Patent Office dated Apr. 21, 2020, which corresponds to European Patent Application No. 18824705.0-1017 and is related to U.S. Appl. No. 16/346,802.

*Primary Examiner* — Erica S Lin
*Assistant Examiner* — Tracey M McMillion
(74) *Attorney, Agent, or Firm* — Studebaker & Brackett PC

(57) ABSTRACT

An inkjet recording apparatus includes memory, a processor, an image forming section, and a bending mechanism. The memory stores therein bending information in which a plurality of bending amounts corresponding to respective ejection amounts of an ink ejected from the image forming section are defined. The processor sets a bending amount of a sheet to be conveyed. The bending mechanism includes a roller and a belt that hold the sheet therebetween, and bends the sheet by moving a position of a center of the roller toward the belt based on the set bending amount. The processor calculates for each of areas of the sheet an amount of the ink ejected to the area, and sets the bending amount of the sheet based on the bending amounts corresponding to
(Continued)

the calculated amounts of the ink ejected to the respective areas in the bending information.

8 Claims, 12 Drawing Sheets

(51) Int. Cl.

| | |
|---|---|
| ***B41J 3/60*** | (2006.01) |
| ***B65H 29/70*** | (2006.01) |
| ***B41J 11/00*** | (2006.01) |

(56) References Cited

U.S. PATENT DOCUMENTS

| | | | | |
|---|---|---|---|---|
| 9,962,961 | B2 | 5/2018 | Chiba et al. | |
| 2007/0064032 | A1 | 3/2007 | Kawabata | |
| 2009/0189337 | A1 | 7/2009 | Vamamoto | |
| 2012/0299992 | A1 | 11/2012 | Ue et al. | |
| 2013/0203579 | A1 | 8/2013 | Vermunt | |
| 2013/0257964 | A1 * | 10/2013 | Itogawa | B41J 11/0005 347/16 |
| 2016/0243854 | A1 | 8/2016 | Chiba et al. | |
| 2016/0355029 | A1 | 12/2016 | Kondo | |
| 2016/0381235 | A1 | 12/2016 | Koda | |

FOREIGN PATENT DOCUMENTS

| | | | | |
|---|---|---|---|---|
| JP | H09-295401 | A | 11/1997 | |
| JP | 2007-076266 | A | 3/2007 | |
| JP | 2009143012 | A * | 7/2009 | |
| JP | 2009-179415 | A | 8/2009 | |
| JP | 2012-245619 | A | 12/2012 | |
| JP | 2016-060595 | A | 4/2016 | |
| JP | 2016-155686 | A | 9/2016 | |
| KR | 950002518 | B1 * | 3/1995 | B65H 29/70 |

* cited by examiner

62

| | (a) At least 0% less than 50% | (b) At least 50% less than 80% | (c) At least 80% less than 400% |
|---|---|---|---|
| Less than 60 g/m$^2$ | 2nd step | 4th step | 6th step |
| At least 60 g/m$^2$ Less than 75 g/m$^2$ | 2nd step | 4th step | 6th step |
| At least 75 g/m$^2$ Less than 90 g/m$^2$ | 1st step | 3rd step | 5th step |
| At least 90 g/m$^2$ Less than 105 g/m$^2$ | 1st step | 3rd step | 4th step |
| At least 105 g/m$^2$ Less than 135 g/m$^2$ | 1st step | 1st step | 1st step |
| At least 136 g/m$^2$ | 1st step | 1st step | 1st step |

α

β1

β

γ

FIG. 7A

63

| | (a) At least 0% less than 50% | (b) At least 50% less than 80% | (c) At least 80% less than 400% |
|---|---|---|---|
| Less than 75 g/m$^2$ | 2nd step | 3rd step | 4th step |
| At least 75 g/m$^2$ Less than 105 g/m$^2$ | 1st step | 2nd step | 2nd step |
| At least 105 g/m$^2$ Less than 135 g/m$^2$ | 1st step | 1st step | 1st step |
| At least 136 g/m$^2$ | 1st step | 1st step | 1st step |

α

β

γ

FIG. 7B

64

| | Z2 | | | Z1 | | |
|---|---|---|---|---|---|---|
| | (d) At least 0% less than 60% | (e) At least 60% less than 100% | (f) At least 100% less than 400% | (a) At least 0% less than 50% | (b) At least 50% less than 80% | (c) At least 80% less than 400% |
| Less than 60 g/m$^2$ | 2nd step | 5th step | 6th step | 2nd step | 4th step | 6th step |
| At least 60 g/m$^2$ Less than 75 g/m$^2$ | 2nd step | 4th step | 6th step | 2nd step | 4th step | 6th step |
| At least 75 g/m$^2$ Less than 90 g/m$^2$ | 1st step | 3rd step | 5th step | 1st step | 3rd step | 5th step |
| At least 90 g/m$^2$ Less than 105 g/m$^2$ | 1st step | 3rd step | 4th step | 1st step | 3rd step | 4th step |
| At least 105 g/m$^2$ Less than 135 g/m$^2$ | 1st step | 1st step | 2nd step | 1st step | 1st step | 1st step |
| At least 136 g/m$^2$ | 1st step | 1st step | 1st step | 1st step | 1st step | 1st step |

$\alpha$ $\beta$ $\gamma$

FIG. 11

65

| | Z4 | | | Z3 | | | |
|---|---|---|---|---|---|---|---|
| | (d) At least 0% less than 60% | (e) At least 60% less than 100% | (f) At least 100% less than 400% | (a) At least 0% less than 50% | (b) At least 50% less than 80% | (c) At least 80% less than 400% | α |
| Less than 75 g/m$^2$ | 2nd step | 3rd step | 4th step | 2nd step | 3rd step | 4th step | β |
| At least 75 g/m$^2$ Less than 105 g/m$^2$ | 1st step | 2nd step | 3rd step | 1st step | 2nd step | 2nd step | β |
| At least 105 g/m$^2$ Less than 135 g/m$^2$ | 1st step | 1st step | 2nd step | 1st step | 1st step | 1st step | β |
| At least 136 g/m$^2$ | 1st step | 1st step | 1st step | 1st step | 1st step | 1st step | β |

γ

FIG. 12

INKJET RECORDING APPARATUS

CROSS-REFERENCE TO RELATED APPLICATIONS

This present application is a Continuation of U.S. patent application Ser. No. 16/346,802 filed on May 1, 2019, which is a U.S. National Phase Application of International Application No. PCT/JP2018/018894 filed on May 16, 2018, which claims the benefit of Japanese Patent Application No. 2017-126003, filed on Jun. 28, 2017, the entire contents of which are incorporated herein by reference.

TECHNICAL FIELD

The present invention relates to an inkjet recording apparatus.

BACKGROUND ART

An inkjet recording apparatus disclosed in Patent Literature 1 prints on a first side of a sheet. After printing on the first side, it is determined whether or not conveyance of the sheet must stop based on image data of an image which has been printed on the first side. When conveyance must be stopped after printing on the first side, a stopping time is determined based on the image data, and the conveyance of the sheet is stopped so that the sheet is put in standby. The reasoning for putting the sheet in standby is to dry ink adhered to the sheet and decrease curling in the sheet. After the determined stopping time has passed, the inkjet recording apparatus prints on a second side of the sheet.

CITATION LIST

Patent Literature

Patent Literature 1

Japanese Patent Application Laid-Open Publication No. 2007-076266

SUMMARY OF INVENTION

Technical Problem

However, a situation arises wherein an ink ejection rate to a specified area of the sheet is higher than an ink ejection rate to other areas. In this situation, stronger curling occurs in the specific area than in the other areas. That is, unevenness occurs in the strength of curling between the areas of the sheet. In this situation, there arises a concern that unless the curling of the sheet is reduced in consideration to the unevenness in the strength of curling, the specific area will remain curled even though the curling in the other areas is reduced. As a result, there arises a concern that the curling of the sheet will not be sufficiently reduced, and that the curling of the sheet will not be effectively reduced.

An objective of the present invention is to provide an inkjet recording apparatus capable of effectively reducing curling of the sheet.

Solution to Problem

According to an aspect of the present invention, an inkjet recording apparatus includes memory, a processor, an image forming section, and a bending mechanism. The memory stores therein bending information in which a plurality of bending amounts corresponding to respective ejection amounts are defined. The ejection amounts are amounts of an ink ejected and are different from each other. The processor is connected to the memory and sets a bending amount of a sheet to be conveyed. The image forming section ejects the ink onto the sheet. The bending mechanism includes a roller and a belt that hold the sheet therebetween, and bends the sheet by moving a position of a center of the roller toward the belt based on the set bending amount. The processor calculates for each of areas included in a region of the sheet an amount of the ink ejected to the area, and sets the bending amount of the sheet based on the bending amounts corresponding to the calculated amounts of the ink ejected to the respective areas in the bending information.

Advantageous Effects of Invention

According to the present invention, curling in a sheet can be effectively reduced.

BRIEF DESCRIPTION OF DRAWINGS

FIG. 7A is a diagram illustrating first bending information.

FIG. 7B is a diagram illustrating second bending information.

FIG. 11 is a diagram illustrating third bending information.

FIG. 12 is a diagram illustrating fourth bending information.

DESCRIPTION OF EMBODIMENTS

Figure 1:
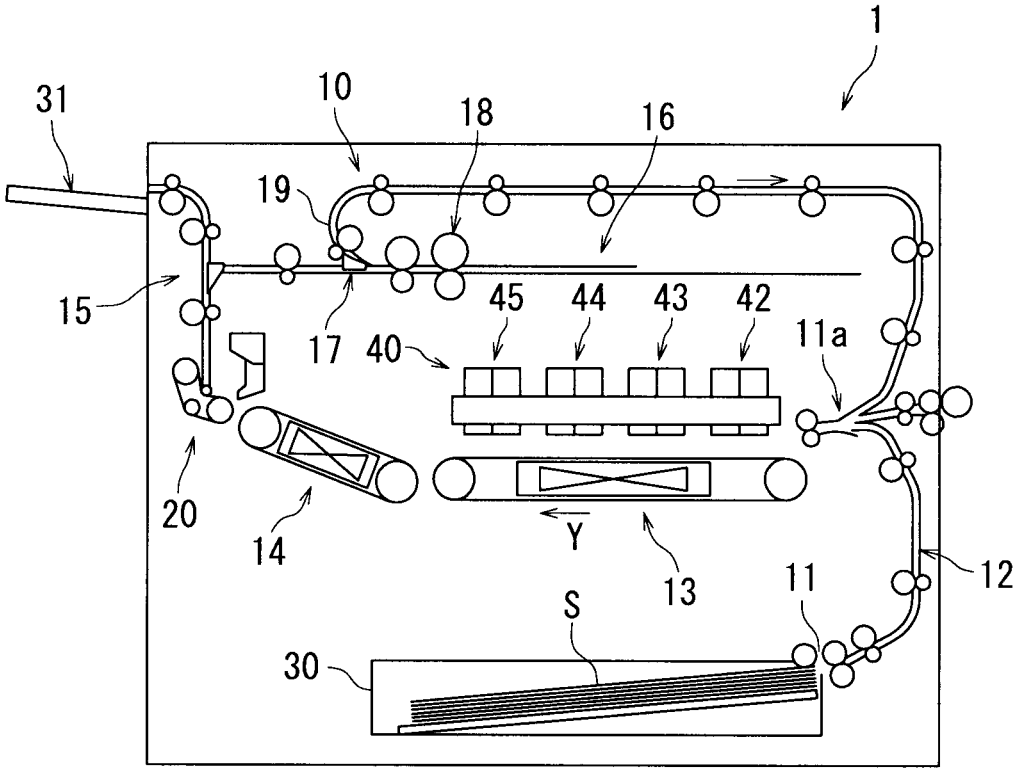
FIG. 1 is a general configuration diagram of an inkjet recording apparatus according to an embodiment of the present invention.

The following describes an embodiment of the present invention with reference to the drawings. Elements that are the same or equivalent are labelled with the same reference signs in the drawings and description thereof is not repeated.

An inkjet recording apparatus 1 according to the embodiment of the present disclosure is described with reference to FIG. 1. FIG. 1 is a general configuration diagram of the inkjet recording apparatus 1.

As illustrated in FIG. 1, the inkjet recording apparatus 1 includes a conveyor device 10, a decurler 20, a cassette 30, an exit tray 31, and an image forming section 40.

The conveyor device 10 includes a feeding section 11, a sheet guiding section 12, a first belt conveyance section 13, a second belt conveyance section 14, a first guiding section 15, a reverse guiding section 16, a diverging section 17, a reversing section 18, and a second guiding section 19.

The cassette 30 houses a sheet S. The feeding section 11 feeds the sheet S housed in the cassette 30 to the sheet guiding section 12. The sheet S is plain paper, thick paper, an overhead projector (OHP) sheet, an envelope, a postcard, or an invoice, for example.

The sheet guiding section 12 guides the sheet S to the image forming section 40. Specifically, the sheet guiding section 12 guides the sheet S fed from the cassette 30 to the image forming section 40 through the first belt conveyance section 13.

The image forming section 40 ejects ink onto the sheet S to form an image on the sheet S. According to the present embodiment, the image forming section 40 ejects inks of a plurality of colors onto the sheet S. In detail, the image forming section 40 ejects ink of four colors on to the sheet S. Specifically, the image forming section 40 includes a first head section 42, a second head section 43, a third head section 44, and a fourth head section 45. The first through fourth head sections 42 to 45 each include a plurality of nozzles. The nozzles provided in the first head section 42 eject a black ink, for example. The nozzles provided in the second head section 43 eject a cyan ink, for example. The nozzles provided in the third head section 44 eject a magenta ink, for example. The nozzles provided in the fourth head section 45 eject a yellow ink, for example. As a result, one or more of the cyan, magenta, yellow, and black inks are attached to the sheet S, and a color or monochrome image is formed on the sheet S by the inks.

There is a possibility that the sheet S will curl upon the inks attaching to the sheet S. In detail, there is a possibility that the sheet S will curl such that an edge of the sheet S bends toward the back side of the sheet S upon the inks attaching to the front side of the sheet S.

The second belt conveyance section 14 conveys the sheet S toward the decurler 20 after the sheet S has passed the image forming section 40. The decurler 20 conveys the sheet S toward the first guiding section 15. The first guiding section 15 guides the sheet S to the exit tray 31 after the sheet S has been sent from the decurler 20. As a result, the sheet S is ejected onto the exit tray 31.

The reverse guiding section 16 diverges from the first guiding section 15. The diverging section 17 is provided in the reverse guiding section 16. The diverging section 17 guides the sheet S toward the reversing section 18 after the sheet S has been sent from the first guiding section 15 to the reverse guiding section 16.

The reversing section 18 is provided in the reverse guiding section 16. The reversing section 18 reverses the advancing direction of the sheet S after the sheet S has been sent from the diverging section 17 and returns the sheet S to the diverging section 17. The diverging section 17 guides the sheet S to the second guiding section 19 after the sheet S has been sent from the reversing section 18. The second guiding section 19 guides the sheet S to a return position 11*a*. Accordingly, after the sheet S has passed the image forming section 40, the sheet S is guided to the return position 11*a* through the second guiding section 19. The return position 11*a* is located in the sheet guiding section 12. The return position 11*a* is also positioned farther upstream in a conveyance direction Y of the sheet S than the image forming section 40. The conveyance direction Y of the sheet S is a movement direction of the sheet S when the image forming section 40 forms an image on the sheet S.

The sheet S guided by the second guiding section 19 to the return position 11*a* has front and back sides reversed. That is, the sheet S is guided to the return position 11*a* with the front and back sides reversed after an image has been formed on the front side. The sheet S is then conveyed to the image forming section 40. The image forming section 40 then forms an image on the back side of the sheet S. Accordingly, the sheet S is returned to the image forming section 40 by the second guiding section 19 after front-side printing has been performed on the sheet S. Back-side printing is then performed on the sheet S. As a result, duplex printing is completed on the sheet S.

Figure 2:
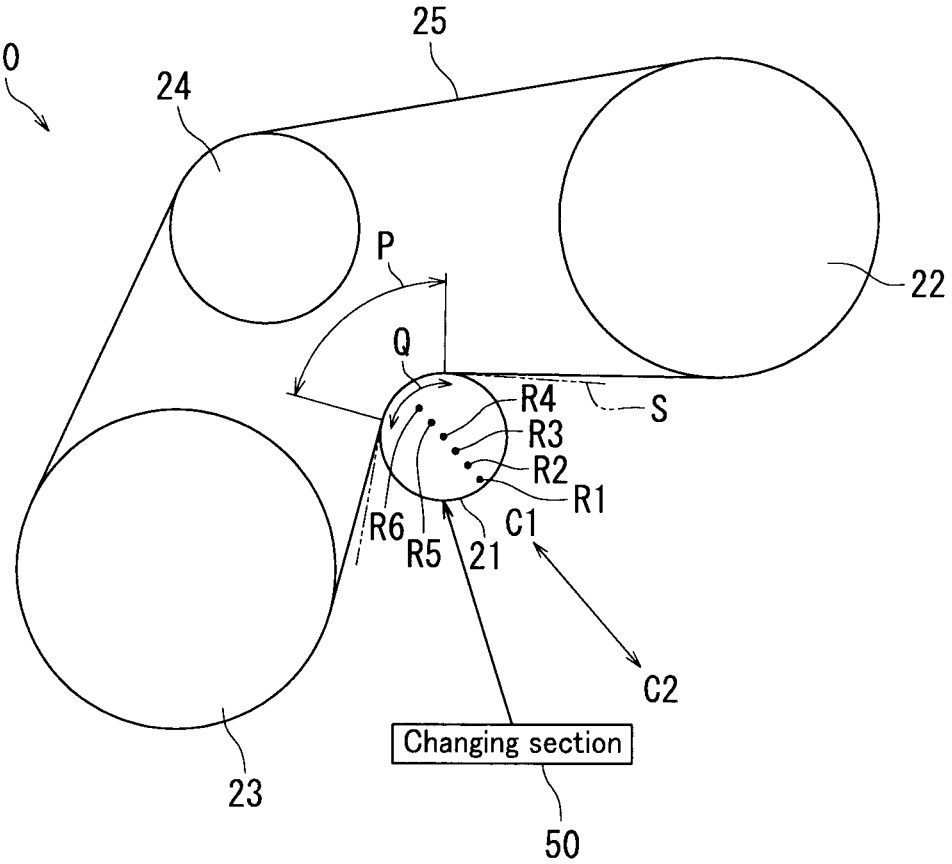
FIG. 2 is a diagram illustrating a decurler.

The following describes the decurler 20 (bending section) with reference to FIG. 2. FIG. 2 is a diagram illustrating the decurler 20.

As illustrated in FIG. 2, the decurler 20 conveys the sheet S while bending the sheet S. Specifically, the decurler 20 includes a first roller 21, a second roller 22, a third roller 23, a fourth roller 24, and a belt 25. The second roller 22, the third roller 23, and the fourth roller 24 are each rotatably supported. The second roller 22, the third roller 23, and the fourth roller 24 are arranged with space therebetween. The belt 25 is an endless belt. The belt 25 is rotatably supported. The belt 25 is elastic. The belt 25 is wound around the plurality of rollers (second roller 22, third roller 23, and fourth roller 24). The first roller 21 is rotatably supported. The first roller 21 is in contact with the belt 25. Specifically, the first roller 21 is in contact with a portion of the belt 25 positioned between the second roller 22 and the third roller 23. The first roller 21 is opposite to the fourth roller 24 with the belt 25 therebetween. The first roller 21 is supported movably in a first direction C1 approaching the fourth roller 24 and a second direction C2 moving away from the fourth roller 24.

At least one of the first roller 21, the second roller 22, the third roller 23, and the fourth roller 24 is a drive roller, and the rollers other than the drive roller are driven rollers. The belt 25 circulates along with rotation of the first roller 21, the second roller 22, the third roller 23, and the fourth roller 24.

The decurler 20 bends the sheet S. Specifically, the first roller 21 and the belt 25 bend the sheet S by rotating while pinching the sheet S therebetween. The decurler 20 bends the sheet S in a direction opposite to the curling direction of the sheet S. As a result, curling in the sheet S can be reduced.

The first roller 21 and the belt 25 also convey the sheet S by rotating while pinching the sheet S therebetween.

The inkjet recording apparatus 1 further includes a changing section 50. The changing section 50 moves the first roller 21 in the first direction C1 and the second direction C2. The changing section 50 includes a motor, for example.

The changing section 50 changes a bending amount of the sheet S. Specifically, the changing section 50 changes the bending amount of the sheet S when the decurler 20 bends the sheet S. According to the present embodiment, the time when the decurler 20 bends the sheet S is a time when the sheet S passes between the first roller 21 and the belt 25.

In the following, the bending amount of the sheet S when the decurler 20 bends the sheet S is referred to as a bending amount of the sheet S.

The bending amount of the sheet S is represented by either or both of a bending width P of the sheet S and pinching force acting on the sheet S.

The bending width P of the sheet S is the size of a bending area of the sheet S. According to the present embodiment, the bending width P of the sheet S is a dimension in a rotating direction Q of an area of the sheet S which is in contact with the first roller 21. The rotating direction Q is a rotating direction of the first roller 21. According to the present embodiment, the area of the sheet S which is in contact with the first roller 21 increases as the first roller 21 moves in the first direction C1. As a result, the bending width P of the sheet S increases as the first roller 21 moves in the first direction C1.

The pinching force acting on the sheet S is pressure acting on the sheet S in the direction in which the sheet S is pinched when the sheet S is pinched from the front and back sides of the sheet S. According to the present embodiment, the belt 25 elastically deforms and lengthens as the first roller 21 moves in the first direction C1. As a result, the resilience of the belt 25 increases and the pinching force acting on the sheet S increases as the first roller 21 moves in the first direction C1.

When the changing section 50 moves the first roller 21 in the first direction C1, the bending width P of the sheet S increases and the pinching force acting on the sheet S increases. As a result, the bending amount of the sheet S increases.

As the bending amount of the sheet S increases, it becomes possible to effectively reduce strong curling in the sheet S.

When the changing section 50 moves the first roller 21 in the second direction C2, the bending width P of the sheet S decreases and the pinching force acting on the sheet S decreases. As a result, the bending amount of the sheet S decreases.

As the bending amount of the sheet S decreases, it becomes possible to effectively reduce weak curling in the sheet S. The reasoning is described in the following. That is, in a case where the sheet S curls weakly, there arises a concern that the sheet S will curl in the bending direction due to excessive bending when the bending amount of the sheet S by the decurler 20 is great. In view of the foregoing, by decreasing the bending amount of the sheet S, curling in the sheet S can be reduced in a manner that the sheet S is bent to an appropriate degree while being prevented from being bent excessively.

The bending amount of the sheet S is changeable in a plurality of steps. According to the present embodiment, the bending amount of the sheet S is changeable in six steps from a first step to a sixth step. The bending amount of the sheet S increases as the number of steps increases. According to the present embodiment, the changing section 50 moves the first roller 21 in the first direction C1 or the second direction C2 to change the position of the first roller 21, thus changing the bending amount of the sheet S to any of the first step to the sixth step.

First to sixth positions R1 to R6 are positions of the first roller 21. In detail, the first to sixth positions R1 to R6 are positions of the center of the first roller 21. When the first roller 21 is positioned in an mth position Rm, the bending amount of the sheet S is at an mth step. m is an integer from 1 to 6. Accordingly, the changing section 50 changes the bending amount of the sheet S to the mth step by moving the position of the first roller 21 to the mth position Rm.

For example, in a case where the changing section 50 includes a motor, the first roller 21 is stopped at a desired position among the first to sixth positions R1 to R6 by adjusting a rotational angle of the motor.

As described above with reference to FIG. 2, the changing section 50 changes the bending amount of the sheet S when the decurler 20 bends the sheet S. Specifically, the changing section 50 changes the bending amount of the sheet S by moving the first roller 21 in the first direction C1 or the second direction C2. Accordingly, the bending amount of the sheet S can be changed according to the strength of curling in the sheet S. As a result, curling in the sheet S can be effectively reduced.

Note that according to the present embodiment, the changing section 50 changes the bending width P of the sheet S and the pinching force acting on the sheet S to change the bending amount of the sheet S. However, the present invention is not limited as such. The changing section 50 may change either or both of the bending width P of the sheet S and the pinching force acting on the sheet S to change the bending amount of the sheet S.

Figure 3:
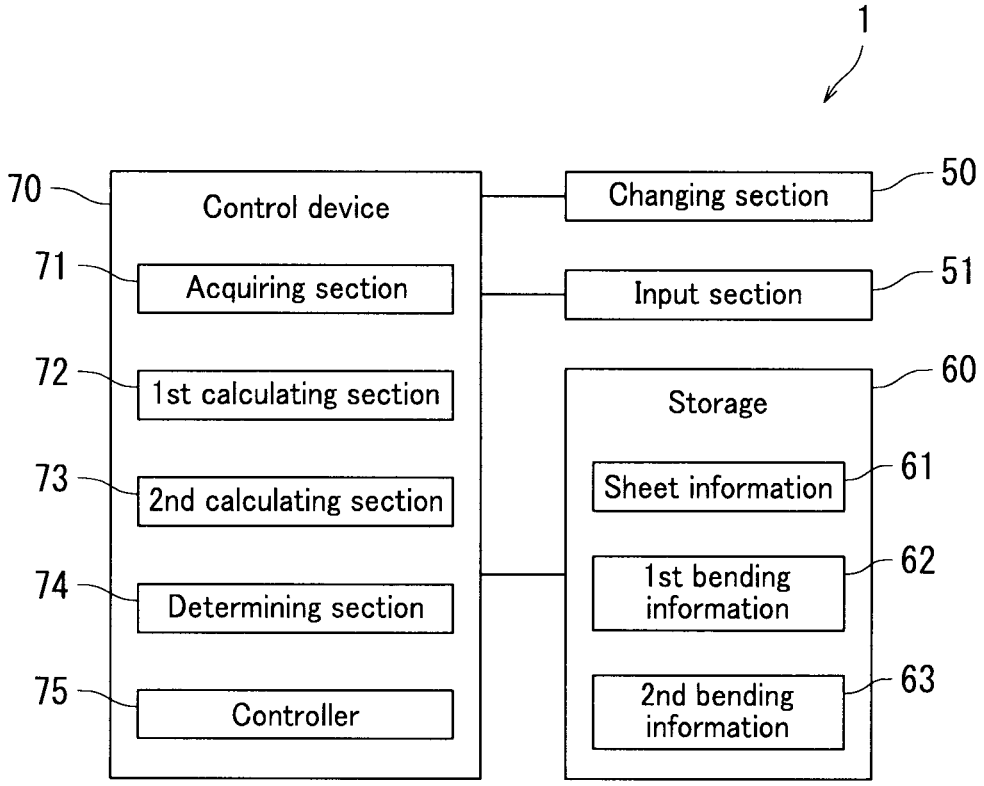
FIG. 3 is a block diagram illustrating the inkjet recording apparatus.

The following further describes the inkjet recording apparatus 1 with reference to FIG. 3. FIG. 3 is a block diagram illustrating the inkjet recording apparatus 1.

As illustrated in FIG. 3, the inkjet recording apparatus 1 further includes an input section 51, storage 60, and a control device 70.

The input section 51 receives an instruction from a user for the inkjet recording apparatus 1. The input section 51 includes either or both of a touch panel and a group of operation keys, for example. The input section 51 is located on a casing of the inkjet recording apparatus 1, for example.

The storage 60 includes a storage device. The storage device includes a main storage device (semiconductor memory, for example) such as read-only memory (ROM) and random-access memory (RAM), and may further include an auxiliary storage device (a hard disk drive, for example). Either or both of the main storage device and the auxiliary storage device store therein various computer programs to be executed by the control device 70.

The storage 60 stores sheet information 61, first bending information 62, and second bending information 63 therein.

The control device 70 includes a processor such as a central processing unit (CPU) and a micro processing unit (MPU). The control device 70 controls each element of the inkjet recording apparatus 1. Specifically, the processor controls the conveyor device 10, the decurler 20, the image forming section 40, the changing section 50, the input section 51, and the storage 60 by executing a computer program stored in the storage device.

The control device 70 includes an acquiring section 71, a first calculating section 72, a second calculating section 73, a determining section 74, and a controller 75. Specifically, the processor functions as the acquiring section 71, the first calculating section 72, the second calculating section 73, the determining section 74, and the controller 75 by executing a computer program stored in the storage device.

Figure 4:
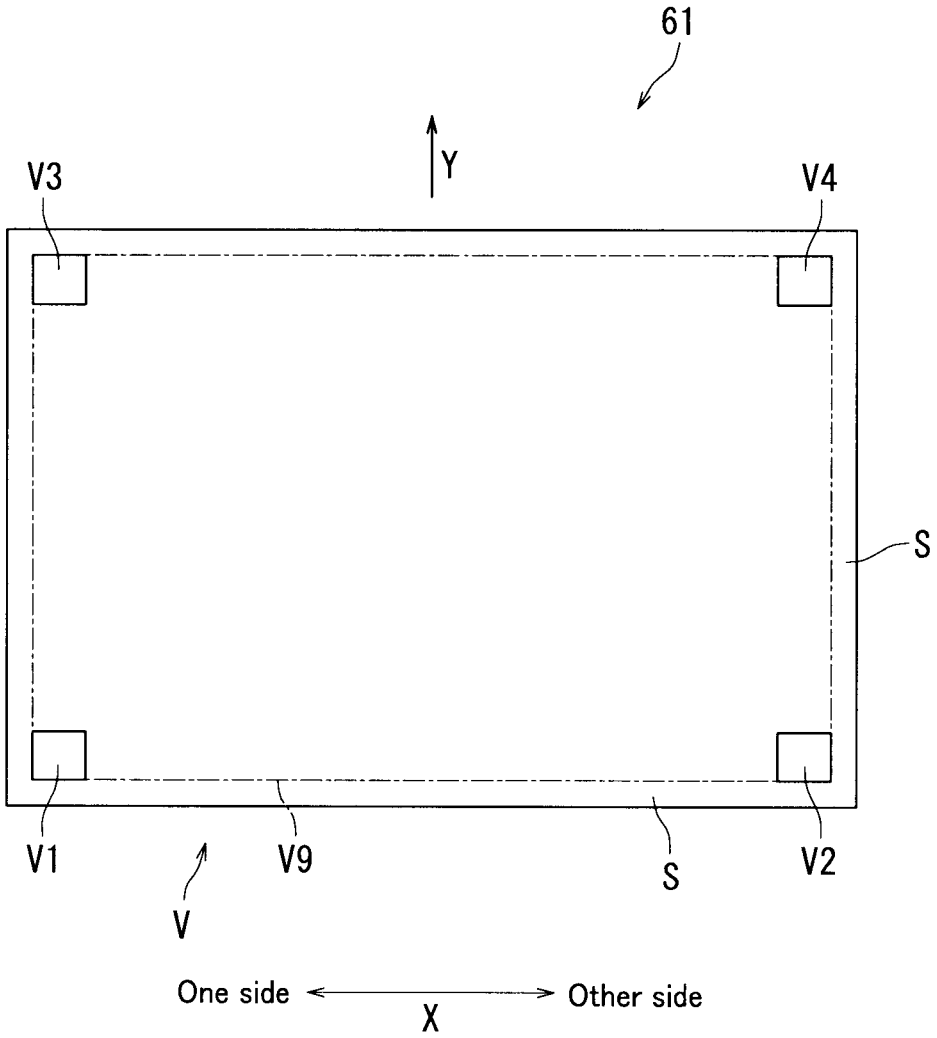
FIG. 4 is a diagram illustrating first to fourth areas.
Figure 5:
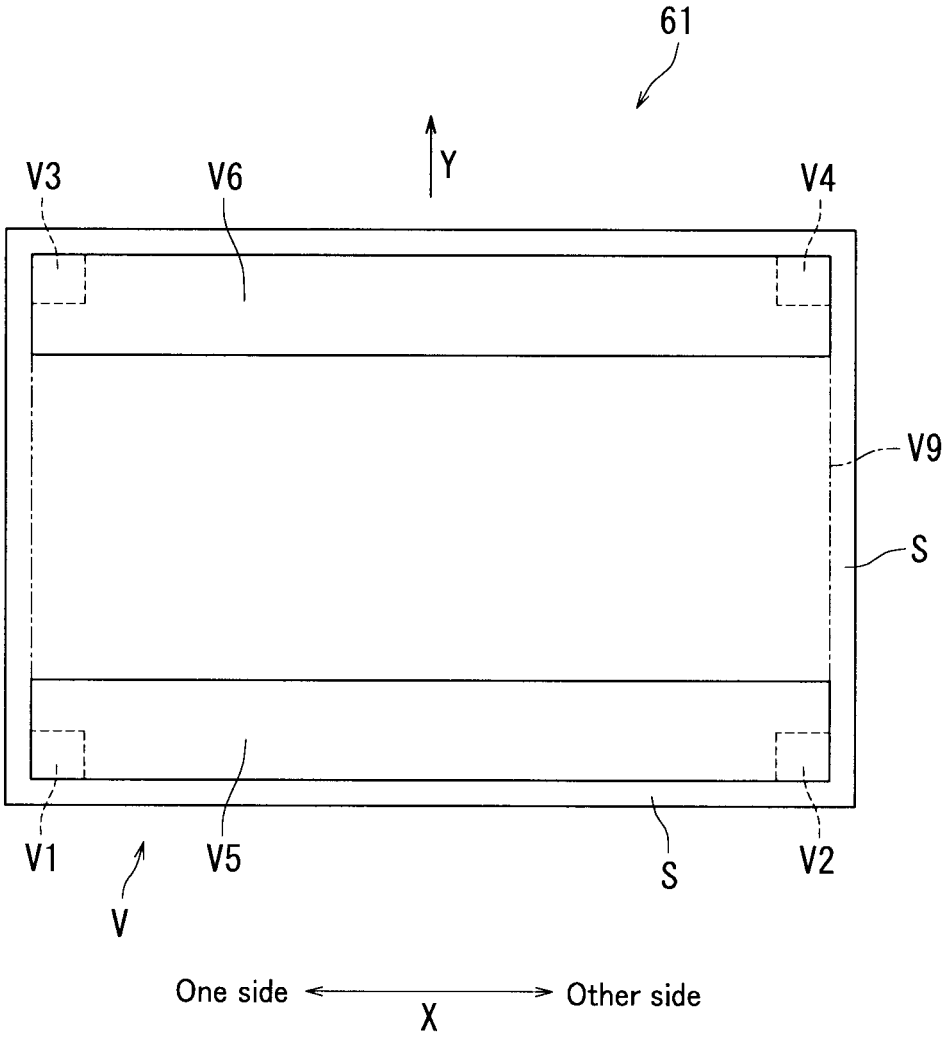
FIG. 5 is a diagram illustrating a fifth area and a sixth area.
Figure 6:
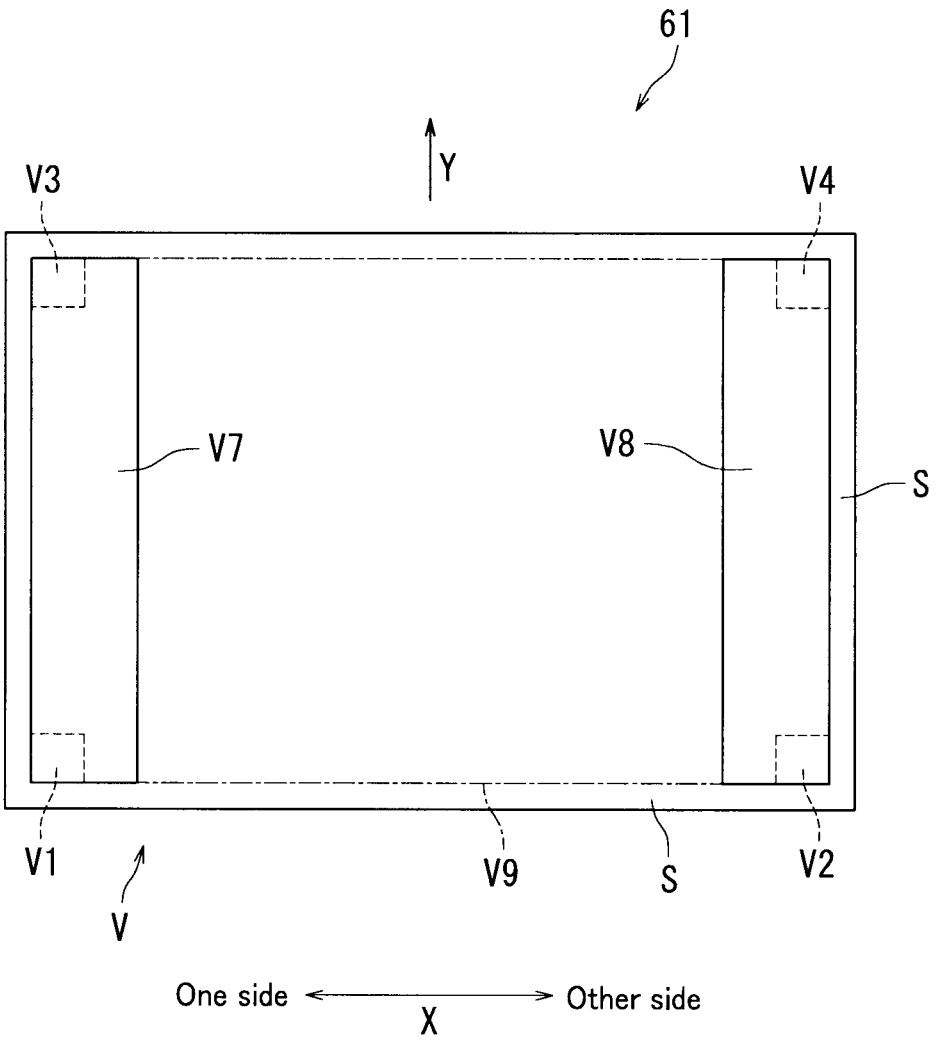
FIG. 6 is a diagram illustrating a seventh area and an eighth area.

The following describes the sheet information 61 with reference to FIGS. 4 to 6. FIGS. 4 to 6 are conceptual diagrams illustrating the sheet information 61.

As illustrated in FIG. 4, the sheet information 61 is information indicating a plurality of areas V set to the sheet S. The areas V are preset. The areas V include a first area V1, a second area V2, a third area V3, and a fourth area V4.

The first area V1 is set to an image formable area V9 of the sheet S. The image formable area V9 is an area of the sheet S in which the image forming section 40 can eject ink. That is, the image forming section 40 is preset so as to eject ink into the image formable area V9 of the sheet S. The boundary of the image formable area V9 is substantially rectangular, and has a pair of boundaries parallel to the conveyance direction Y and a pair of boundaries perpendicular to the conveyance direction Y. The image formable area V9 has a plurality of corners. Specifically, the image formable area V9 has four corners.

The first area V1 is an area positioned farthest upstream in the conveyance direction Y and on one side in a width direction X of the sheet S among the corners of the image formable area V9. The width direction X of the sheet S is a direction perpendicular to the conveyance direction Y.

The second area V2 is an area positioned farthest upstream in the conveyance direction Y and on the other side in the width direction X among the corners of the image formable area V9. The third area V3 is an area positioned farthest downstream in the conveyance direction Y and on the one side in the width direction X among the corners of the image formable area V9. The fourth area V4 is an area positioned farthest downstream in the conveyance direction Y and on the other side in the width direction X among the corners of the image formable area V9.

As illustrated in FIG. 5, the areas V further include a fifth area V5 and a sixth area V6. The fifth area V5 is an area along an edge of the image formable area V9 farthest upstream in the conveyance direction Y. The fifth area V5 is set across the image formable area V9 from an end on the one side to an end on the other side in the width direction X. Accordingly, parts of the fifth area V5 overlap with the first area V1 and the second area V2. The sixth area V6 is an area along an edge of the image formable area V9 farthest downstream in the conveyance direction Y. The sixth area V6 is set across the image formable area V9 from an end on the one side to an end on the other side in the width direction X. Accordingly, parts of the sixth area V6 overlap with the third area V3 and the fourth area V4.

As illustrated in FIG. 6, the areas V further include a seventh area V7 and an eighth area V8. The seventh area V7 is an area along an edge of the image formable area V9 on the one side in the width direction X. The seventh area V7 is set across the image formable area V9 from an end upstream to an end downstream in the conveyance direction Y. Accordingly, parts of the seventh area V7 overlap with the first area V1 and the third area V3. The eighth area V8 is an area along an edge of the image formable area V9 on the other side in the width direction X. The eighth area V8 is set across the image formable area V9 from an end upstream to an end downstream in the conveyance direction Y. Accordingly, parts of the eighth area V8 overlap with the second area V2 and the fourth area V4.

As described above with reference to FIGS. 4 to 6, the first to eighth areas V1 to V8 are positioned on edges of the image formable area V9. Generally, an edge of the image formable area V9 curls more easily when ink is attached than the center of the image formable area V9. Accordingly, the first to eighth areas V1 to V8 located on the edges of the image formable area V9 curl easily.

To reflect that the first to eighth areas V1 to V8 curl easily, the first to eighth areas V1 to V8 are included in the areas V.

The first to fourth areas V1 to V4 are positioned at the corners of the image formable area V9, and overlap with parts of the fifth to eighth areas V5 to V8. Generally, a corner of the edges of the image formable area V9 curls more easily when ink is attached to the edges of the image formable area V9 than other parts. Accordingly, the first to fourth areas V1 to V4 at the corners of the image formable area V9 curl more easily than the fifth to eighth areas V5 to V8.

To reflect that the first to fourth areas V1 to V4 curl easily, the first to fourth areas V1 to V4 are included in the areas V.

The following describes the first bending information 62 (bending information) with reference to FIG. 7A. FIG. 7A is a conceptual diagram illustrating the first bending information 62.

As illustrated in FIG. 7A, the first bending information 62 is set for "plain paper". The first bending information 62 indicates a first target bending amount β of a specific area of the sheet S corresponding to an ink ejection rate α to the specific area. The specific area is an nth area Vn when the areas V include the first area V1 to an Mth area VM. M is an integer of 2 or greater. According to the present embodiment, M is equal to 8. n is an integer from 1 to M. That is, n is a variable and represents any integer from 1 to M.

The ink ejection rate α is specifically an ejection rate of ink ejected from the image forming section 40. According to the present embodiment, the ink ejection rate a is represented by a percentage. The ink ejection rate α to the specific area is a ratio of ink surface area to the surface area of the specific area. The ink surface area is a total surface area occupied by the plurality of colored inks ejected from the image forming section 40 within the specific area of the sheet S. According to the present embodiment, the image forming section 40 ejects four colored inks. Accordingly, a minimum value of the ink ejection rate α to the specific area is 0%, and a maximum value is 400%. That is, the ink ejection rate α to the specific area is 0% when none of the four colored inks are attached to the specific area. When one of the four colored inks is attached to the entirety of the specific area and none of the other three of the four colored inks are attached to the specific area, the ink ejection rate α to the specific area is 100%. When each of the four colored inks is attached to the entirety of the specific area, the ink ejection rate α to the specific area is 400%. According to the present embodiment, the specific area is each of the first to eighth areas V1 to V8.

The ink ejection rate α to the specific area represents the amount of ink ejected to the specific area as a ratio of the ink surface area to the surface area of the specific area. Accordingly, the ink ejection rate α to the specific area is an example of an ejection amount of ink to the specific area. That is, the first bending information 62 indicates the first target bending amount β of the specific area corresponding to the ejection amount of ink to the specific area.

The first target bending amount β of the specific area is a bending amount of the sheet S suitable for reducing curling in the sheet S. The first target bending amount β of the specific area is found by testing, for example.

The first target bending amount β of the specific area is set to any of the first to sixth steps.

Generally, stronger curling occurs in the specific area as the ink ejection rate α to the specific area increases. Accordingly, the first target bending amount β of the specific area increases as the ink ejection rate α to the specific area increases. That is, the number of steps indicating the first target bending amount β of the specific area increases as the ink ejection rate α to the specific area increases.

The first target bending amount β of the specific area is set corresponding to the ink ejection rate α to the specific area. According to the present embodiment, the first target bending amount β of the specific area is set for when: (a) the ink ejection rate a to the specific area is at least 0% and less than 50%; (b) the ink ejection rate α to the specific area is at least 50% and less than 80%; and (c) the ink ejection rate α to the specific area is at least 80% and less than 400%.

Also according to the present embodiment, the first bending information 62 indicates the first object bending amount β of the specific area corresponding to the ink ejection rate α to the specific area for each specific range of basis weight γ of the sheet S. The specific ranges are preset. Generally, the specific area curls more easily as the basis weight γ of the sheet S decreases. Accordingly, the first target bending amount β of the specific area increases as the basis weight γ of the sheet S decreases. That is, the number of steps indicating the first target bending amount β of the specific area increases as the basis weight γ of the sheet S decreases.

The following describes the second bending information 63 (bending information) with reference to FIG. 7B. FIG. 7B is a conceptual diagram illustrating the second bending information 63.

The second bending information 63 differs from the first bending information 62 set for "plain paper" by being set for "inkjet paper".

In the second bending information 63, various information is set likewise to the first bending information 62. Specifically, the second bending information 63 indicates the first object bending amount β of the specific area corresponding to the ink ejection rate α (ejection amount of ink) to the specific area. The first target bending amount β of the specific area is set corresponding to the ink ejection rate α to the specific area. Also according to the present embodiment, the second bending information 63 indicates the first target bending amount β of the specific area corresponding to the ink ejection rate α to the specific area for each specific range of the basis weight γ of the sheet S.

In the second bending information 63, the first target bending amount β of the specific area is set to suit the properties of inkjet paper. In the first bending information 62 by contrast, the first target bending amount β of the specific area is set to suit the properties of plain paper. Accordingly, differences may arise when comparing the first bending information 62 and the second bending information 63 under the conditions that the ink ejection rate α and the basis weight γ of the sheet S are the same therebetween.

As described above with reference to FIGS. 7A and 7B, the first target bending amount β is set to reflect the basis weight γ of the sheet S in each of the first bending information 62 and the second bending information 63. As a result, the first target bending amount β can be set with high precision.

Note that the first target bending amount β may be set in each of the first bending information 62 and the second bending information 63 without reflecting the basis weight γ of the sheet S and with no relation to the basis weight γ of the sheet S. That is, in the first bending information 62 and the second bending information 63, the first target bending amount β may not be classified according to the basis weight γ of the sheet S in setting the first target bending amount β. As a result, it is possible to reduce the amount of information of the first bending information 62 and the second bending information 63, and thus reduce an area of the storage 60 occupied by the first bending information 62 and the second bending information 63.

In the following, the first bending information 62 and the second bending information 63 may be collectively referred to as bending information. The bending information is provided for each type of the sheet S. According to the present embodiment, the first bending information 62 is provided as bending information for plain paper. The second bending information 63 is provided as bending information for inkjet paper. That is, according to the present embodiment, two types of bending information are provided to suit the type of the sheet S. As a result, the first target bending amount β can be set to reflect the type of the sheet S with high precision.

Note that the first bending information 62 and the second bending information 63 may be combined as one, and configured as one type of bending information. That is, the bending information is not provided for each type of the sheet S, and the type of the sheet S is not reflected in the bending information. As a result, it is possible to reduce the amount of the bending information, and thus reduce an area of the storage 60 occupied by the bending information.

Figure 8:
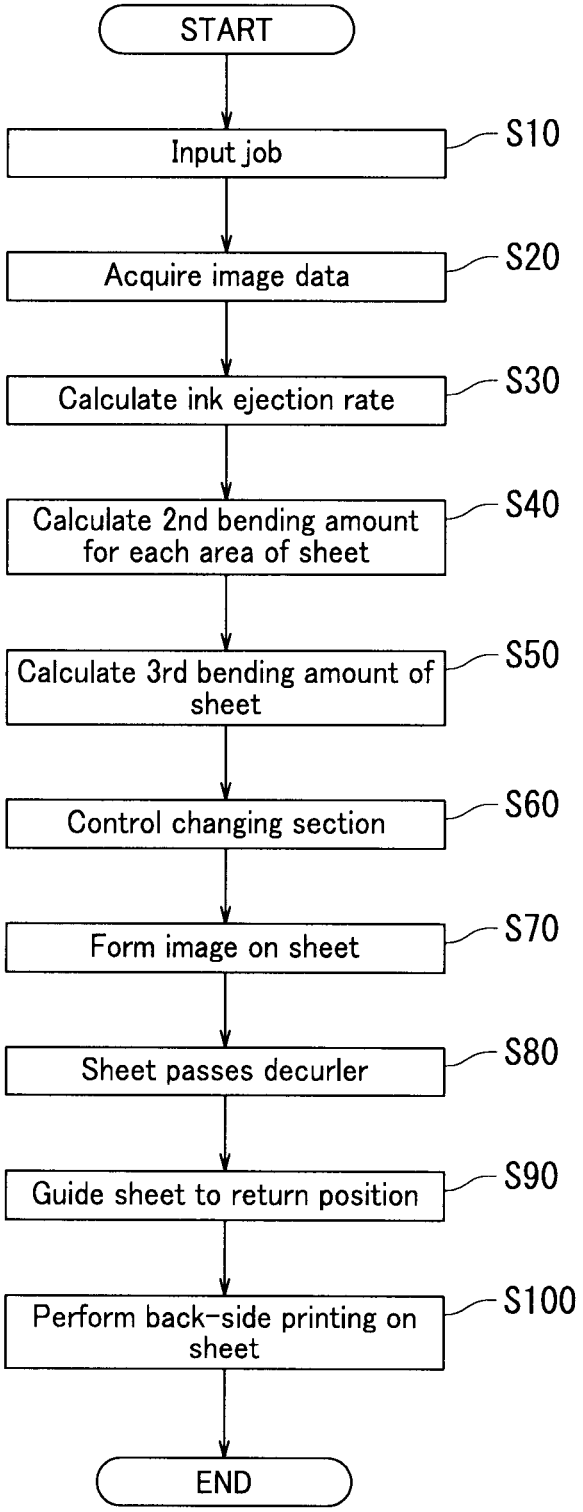
FIG. 8 is a flowchart illustrating operation of a control device.

The following describes operation of the control device 70 with reference to FIGS. 7A, 8, 9A, 9B, and 10. FIG. 8 is a flowchart depicting the operation of the control device 70.

As illustrated in FIG. 8, the input section 51 receives a job instruction from the user for the inkjet recording apparatus 1 in Step S10. According to the present embodiment, one job instruction is an instruction to form an image on the sheet S. Another job instruction is an instruction to designate the type of the sheet S. Another job instruction is an instruction to designate the basis weight γ of the sheet S. Another job instruction is an instruction to perform duplex printing on the sheet S. According to the present embodiment, plain paper is designated as the type of the sheet S. Also according to the present embodiment, 70 g/m$^2$ is designated as the basis weight γ of the sheet S.

In Step S20, the acquiring section 71 acquires image data. The image data is data representing an image to be formed on the sheet S by the image forming section 40. The acquiring section 71 for example acquires the image data from an external computer in a wired or wireless manner.

Figure 9A:
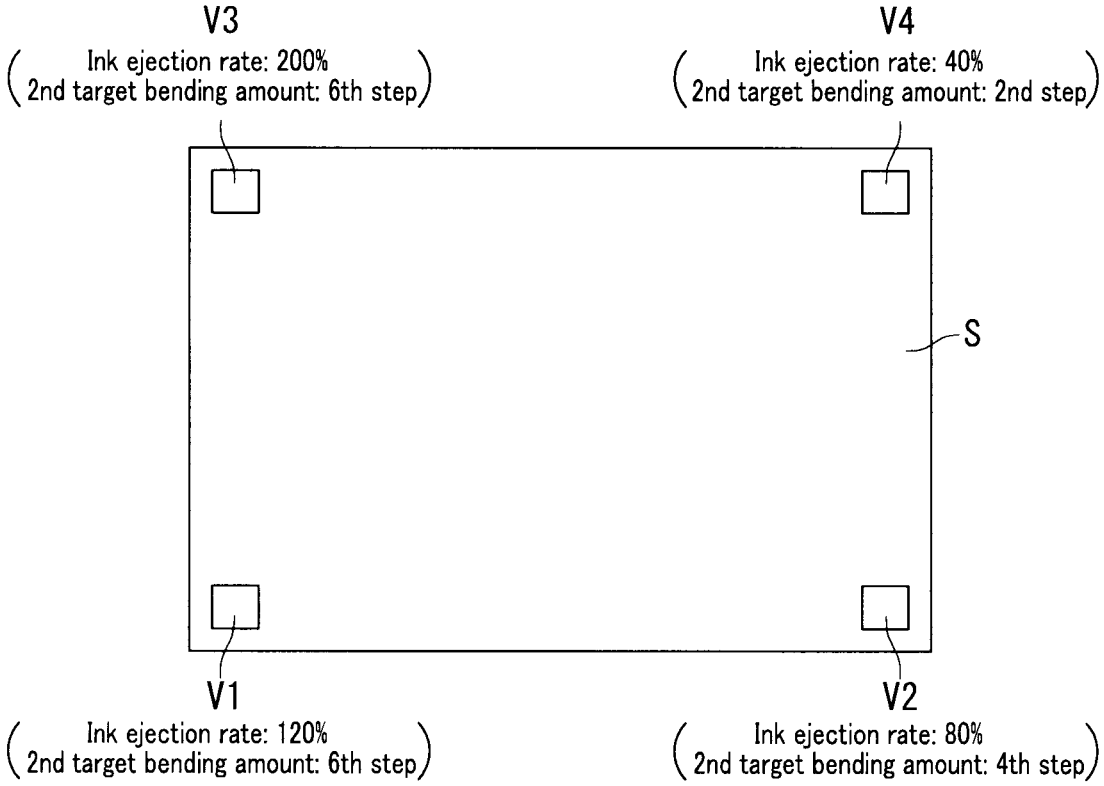
FIG. 9A is a diagram illustrating an ink ejection rate to each of the first to fourth areas.
Figure 9B:
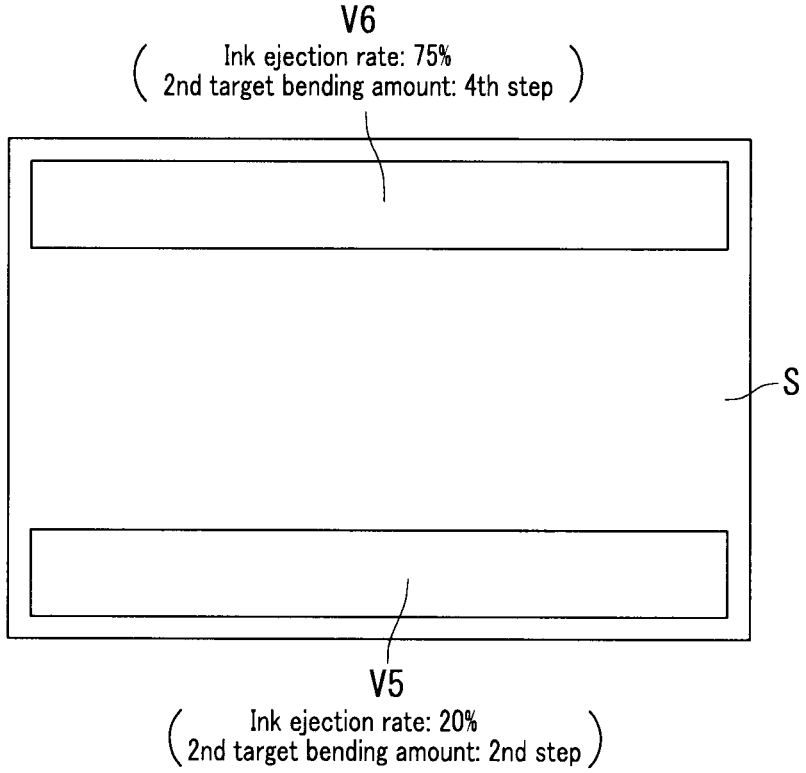
FIG. 9B is a diagram illustrating the ink ejection rate to each of the fifth area and the sixth area.
Figure 10:
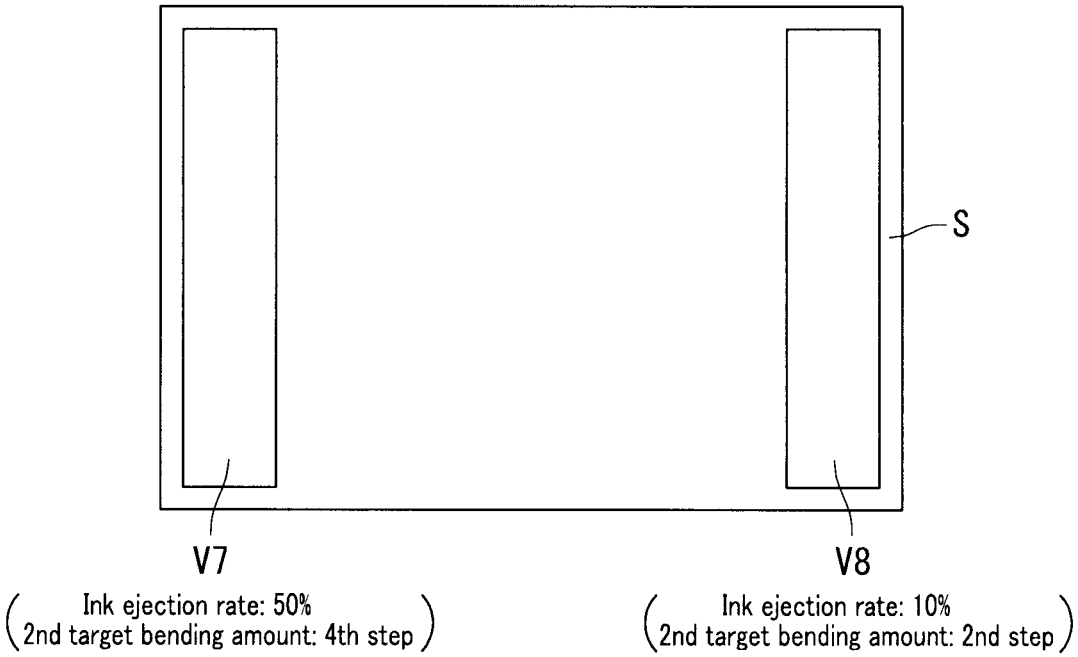
FIG. 10 is a diagram illustrating the ink ejection rate to each of the seventh area and the eighth area.

FIGS. 9A, 9B, and 10 are diagrams illustrating the ink ejection rate α to the specific area and illustrate the ink ejection rate α to each of the areas V.

As illustrated in FIGS. 8, 9A, 9B, and 10, the first calculating section 72 acquires image data from the acquiring section 71 in Step S30. The first calculating section 72 then calculates, based on the image data, the ink ejection rate α (ejection amount of ink) to the sheet S for each area. According to the present embodiment, the first calculating section 72 calculates the ink ejection rate α for each area of the first to eighth areas V1 to V8.

According to the present embodiment, the ink ejection rate α to the first area V1 is 120%.

The ink ejection rate α to the second area V2 is 80%.

The ink ejection rate α to the third area V3 is 200%.

The ink ejection rate α to the fourth area V4 is 40%.

The ink ejection rate α to the fifth area V5 is 20%.

The ink ejection rate α to the sixth area V6 is 75%.

The ink ejection rate α to the seventh area V7 is 50%.

The ink ejection rate α to the eighth area V8 is 10%.

As illustrated in FIGS. 7A, 8, 9A, 9B, and 10, the second calculating section 73 calculates a second target bending amount of each area V based on the first bending information 62 and the ink ejection rate α (ejection amount of ink) calculated by the first calculating section 72 for each area in Step S40.

According to the present embodiment, the type of the sheet S input to the input section 51 is plain paper, and the basis weight γ of the sheet S input to the input section 51 is 70 g/m$^2$ in Step S10. Accordingly, the second calculating section 73 calculates a second target bending amount of each area V based on a row β1 of the first bending information 62 illustrated in FIG. 7A.

The ink ejection rate α to the first area V1 is 120%. Accordingly, the second calculating section 73 calculates that the second target bending amount of the first area V1 is the sixth step.

The ink ejection rate α to the second area V2 is 80%. Accordingly, the second calculating section 73 calculates that the second target bending amount of the second area V2 is the sixth step.

The ink ejection rate α to the third area V3 is 200%. Accordingly, the second calculating section 73 calculates that the second target bending amount of the third area V3 is the sixth step.

The ink ejection rate α to the fourth area V4 is 40%. Accordingly, the second calculating section 73 calculates that the second target bending amount of the fourth area V4 is the second step.

The ink ejection rate α to the fifth area V5 is 20%. Accordingly, the second calculating section 73 calculates that the second target bending amount of the fifth area V5 is the second step.

The ink ejection rate α to the sixth area V6 is 75%. Accordingly, the second calculating section 73 calculates that the second target bending amount of the sixth area V6 is the fourth step.

The ink ejection rate α to the seventh area V7 is 50%. Accordingly, the second calculating section 73 calculates that the second target bending amount of the seventh area V7 is the fourth step.

The ink ejection rate α to the eighth area V8 is 10%. Accordingly, the second calculating section 73 calculates that the second target bending amount of the eighth area V8 is the second step.

In Step S50, the determining section 74 determines a third target bending amount of the sheet S based on the plurality of second target bending amounts. The second target bending amounts are all of the second target bending amounts calculated by the first calculating section 72 for the respective areas. Accordingly in the present embodiment, the second target bending amounts each are a second target bending amount of a corresponding one of the first area V1 to the eighth area V8. The determining section 74 determines the highest of the second target bending amounts to be the third target bending amount of the sheet S. According to the present embodiment, the highest second target bending amounts are the sixth step indicating the second target bending amount of the first area V1, the sixth step indicating the second target bending amount of the second area V2, and the sixth step indicating the second target bending amount of the third area V3. Accordingly, the determining section 74 determines the third target bending amount of the sheet S to be the sixth step.

In Step S60, the controller 75 controls the changing section 50 based on the second target bending amounts. In detail, the controller 75 controls the changing section 50 such that the decurler 20 bends the sheet S by the third target bending amount. According to the present embodiment, the controller 75 controls the changing section 50 such that the bending amount of the sheet S is the sixth step. That is, the controller 75 controls the changing section 50 such that the changing section 50 moves the first roller 21 to the sixth position R6(FIG. 2).

In Step S70, the controller 75 controls the image forming section 40 such that the image forming section 40 forms an image on the sheet S. In detail, the controller 75 controls the conveyor device 10. As a result, the sheet S in the cassette 30 is conveyed to the image forming section 40. The controller 75 then controls the image forming section 40. As a result, the image forming section 40 ejects ink on to the sheet S to form an image on the sheet S.

In Step S80, the controller 75 controls the conveyor device 10. As a result, the sheet S passes the second belt conveyance section 14. The controller 75 then controls the decurler 20. As a result, the sheet S passes the decurler 20. When the sheet S passes the decurler 20, the decurler 20 bends the sheet S by the third target bending amount. In detail, the decurler 20 bends the sheet S by the third target bending amount in a direction opposite to the curling direction of the sheet S. According to the present embodiment, the third target bending amount is the sixth step. Therefore, when the sheet S passes the decurler 20, the decurler 20 bends the sheet S by the sixth step.

In Step S90, the controller 75 controls the second guiding section 19 such that the second guiding section 19 guides the sheet S to the return position 11*a* (FIG. 1) after the sheet S has passed the decurler 20. As a result, the sheet S is conveyed to the return position 11*a*.

In Step S100, the controller 75 controls the image forming section 40. As a result, the image forming section 40 forms an image on the back side of the sheet S, thus performing back-side printing on the sheet S. The back side of the sheet S is a side opposite to the side of the sheet S on which the image is formed in Step S70. After the back-side printing has been performed, the sheet S is ejected onto the exit tray 31.

As described above with reference to FIGS. 7A, 8, 9A, 9B, and 10, the controller 75 controls the changing section 50 based on the second target bending amounts. Accordingly, the changing section 50 can change the bending amount of the sheet S such that the sheet S bends in a direction opposite to the curling direction of the sheet S by a bending amount which reflects unevenness in the strength of curling between the respective areas of the sheet S. As a result, curling in the sheet S can be effectively reduced.

The determining section 74 also determines the third target bending amount of the sheet S based on the second target bending amounts. The controller 75 then controls the changing section 50 such that the decurler 20 bends the sheet S by the third target bending amount. Accordingly, the determining section 74 can determine the third bending amount to reflect the strength (ink ejection rate α) of curling in each area V. As a result, the decurler 20 can bend the sheet S by a bending amount which reflects unevenness in the strength of curling between the respective areas of the sheet S, and can effectively reduce curling in the sheet S.

The first target bending amount β of the specific area is set to one of the first to sixth steps. Accordingly, the decurler 20 bends the sheet S stepwise according to the strength of curling in the sheet S, and can effectively reduce curling in the sheet S.

The decurler 20 conveys the sheet S in the conveyance direction Y while bending the sheet S. Accordingly, the decurler 20 bends the sheet S and reduces curling in the sheet S without stopping the sheet S. As a result, the process of reducing curling in the sheet S can be smoothly performed.

The determining section 74 also determines the highest of the second target bending amounts to be the third target bending amount of the sheet S. Accordingly, the decurler 20 bends the sheet S by a bending amount able to reduce curling in the area of the strongest curling in the sheet S. As a result, curling can be prevented from remaining in the sheet S, and curling in the sheet S can be effectively reduced.

The embodiment of the present invention is described above with reference to the drawings (FIGS. 1 to 10). However, the present invention is not limited to the above embodiment and may be implemented in various manners within a scope not departing from the gist of the present invention ((1) to (6), for example). Furthermore, various inventions may be created by appropriately combining the elements of configuration disclosed in the above embodiment. For example, some of elements of configuration may be removed from the elements of configuration disclosed in the embodiment. The drawings schematically illustrate main elements of configuration to facilitate understanding. Aspects of the elements of configuration such as number thereof illustrated in the drawings may differ in practice for the sake of convenience for drawing preparation. Furthermore, the elements of configuration illustrated in the above embodiment are examples and are not particularly limited. The elements of configuration may be variously altered within a scope not substantially departing from the effects of the present invention.

(1) According to the present invention, the areas V include the first to eighth areas V1 to V8. However, the present invention is not limited as such. The areas V may include only the first area V1, the second area V2, and the fifth area V5. Specifically, the areas V only include the first area V1, the second area V2, and the fifth area V5 when front-side printing of duplex printing is performed on the sheet S. The reasoning is indicated in the following. When performing front-side printing and back-side printing on the sheet S, the conveyance direction Y of the sheet S is reversed. Thus, the first area V1, the second area V2, and the fifth area V5 located on a trailing part of the sheet S in front-side printing are located on a leading part of the sheet S in back-side printing. Accordingly, when performing back-side printing on the sheet S, there arises a concern that the leading part (first area V1, second area V2, and fifth area V5) of the sheet S will curl and make contact with the image forming section 40. Thus, the sheet S will be obstructed from advancing smoothly. As a result, reduction of curling in the first area V1, the second area V2, and the fifth area V5 is given priority to ensure that the sheet S advances smoothly, and the areas V include the first area V1, the second area V2, and the fifth area V5.

When front-side printing of duplex printing is performed on the sheet S, the first calculating section 72 calculates a second target bending amount of each of the first area V1, the second area V2, and the fifth area V5, but does not calculate a second target bending amount of each of the third area V3, the fourth area V4, or the sixth to eighth areas V6 to V8. As a result, the computational burden of the first calculating section 72 can be reduced when performing front-side printing of duplex printing on the sheet S.

According to the present embodiment, for example, when the input section 51 has received an instruction to perform duplex printing on the sheet S in Step S10 of FIG. 8, the first calculating section 72 calculates the second target bending amount of each of the first area V1, the second area V2, and the fifth area V5 in Step S40.

(2) When back-side printing of duplex printing is performed on the sheet S, the areas V may only include the third area V3, the fourth area V4, and the sixth area V6. The reasoning is such that the sheet S is conveyed and ejected without being reversed after back-side printing is performed on the sheet S.

(3) According to the present embodiment, the areas V include the first to eighth areas V1 to V8. However, the present invention is not limited as such. The areas V may only include the first to fourth areas V1 to V4, the fifth area V5, and the sixth area V6. Specifically, in a situation in which an image is formed on a sideways sheet S, the areas V only include the first to fourth areas V1 to V4, the fifth area V5, and the sixth area V6. The reasoning is that generally, when an image is formed on the sideways sheet S, the first to fourth areas V1 to V4, the fifth area V5, and sixth area V6 curl easily in the image formable area V9 of the sheet S.

In a situation in which an image is formed on the sideways sheet S, the first calculating section 72 calculates a second target bending amount of each of the first to fourth areas V1 to V4, the fifth area V5, and the sixth area V6, but does not calculate a second target bending amount of the seventh area V7 or the eighth area V8. That is, when an image is formed on the sideways sheet S, the first calculating section 72 calculates second target bending amounts of areas of the sideways sheet S that curl easily (first to fourth areas V1 to V4, fifth area V5, and sixth area V6), but does not calculate second target bending amounts of areas that do not curl easily (seventh area V7 and eighth area V8). As a result, the computational burden of the first calculating section 72 can be reduced in image formation on the sideways sheet S.

According to the present embodiment, for example, when the input section 51 has received an instruction to form an image on a sideways sheet S in Step S10 illustrated in FIG. 8, the first calculating section 72 calculates the second target bending amount of each of the first to fourth areas V1 to V4, the fifth area V5, and the sixth area V6 in Step S40.

(4) According to the present embodiment, the areas V include the first to eighth areas V1 to V8. However, the present invention is not limited as such. The areas V may only include the first to fourth areas V1 to V4, the seventh area V7, and the eighth area V8. Specifically, in a situation in which an image is formed on a vertical sheet S, the areas V only include the first to fourth areas V1 to V4, the seventh area V7, and the eighth area V8. The reasoning is that generally, when an image is formed on a vertical sheet S, the first to fourth areas V1 to V4, the seventh area V7, and the eighth area V8 curl easily in the image formable area V9 of the sheet S.

In a situation in which an image is formed on the vertical sheet S, the first calculating section 72 calculates a second target bending amount of each of the first to fourth areas V1 to V4, the seventh area V7, and the eighth area V8, but does not calculate a second target bending amount of the fifth area V5 or the sixth area V6. As a result, the computational burden of the first calculating section 72 can be reduced in image formation on the vertical sheet S.

According to the present embodiment, for example, when the input section 51 has received an instruction to form an image on a vertical sheet S in Step S10 illustrated in FIG. 8, the first calculating section 72 calculates a second target bending amount of each of the first to fourth areas V1 to V4, the seventh area V7, and the eighth area V8 in Step S40.

(5) According to the present embodiment, the determining section 74 determines the highest of the second target bending amounts to be the third target bending amount of the sheet S. However, the present invention is not limited as such. The determining section 74 need only determine the third target bending amount of the sheet S based on the second target bending amounts. The determining section 74 may determine for example an average of the second target bending amounts to be the third target bending amount of the sheet S. As such, the position of the first roller 21 is set corresponding to an acquired value (number of steps) of the average of the second target bending amounts. For example, when the average of the second target bending amounts is between the second and third steps, the first roller 21 is positioned at a position between the second position R2 and the third position R3 corresponding to the value between the second and third steps.

By determining the average of the second target bending amounts to be the third target bending amount of the sheet S, curling in the sheet S that is a mixture of strong and weak curling can be reduced on average.

(6) According to the present embodiment, the areas V include the first to eighth areas V1 to V8. However, the present invention is not limited as such. The areas V may include a ninth area in addition to the first to eighth areas V1 to V8. The ninth area is the entirety of the image formable area V9, and is therefore the same as the image formable area V9. In the following, the ninth area is referred to as a ninth area V9.

The following describes third bending information 64 which is a variation of the first bending information 62 (FIG. 7A) with reference to FIG. 11. FIG. 11 is a conceptual diagram illustrating the third bending information 64.

The third bending information 64 is information set for plain paper likewise to the first bending information 62. The third bending information 64 differs from the first bending information 62 by the addition of second information Z2 for the ninth area V9.

As illustrated in FIG. 11, the third bending information 64 indicates the first target bending amount β of the specific area corresponding to the ink ejection rate α (ejection amount of ink) to the specific area in a case where the areas V include the first to ninth areas V1 to V9. The third bending information 64 includes two types of information: first information Z1 for the first to eighth areas V1 to V8 and the second information Z2 for the ninth area V9. The first information Z1 for the first to eighth areas V1 to V8 is the same as the first bending information 62.

In the second information Z2 for the ninth area V9, the first target bending amount β of the specific area is set for when: (d) the ink ejection rate α to the specific area is at least 0% and less than 60%; (e) the ink ejection rate α to the specific area is at least 60% and less than 100%; and (f) the ink ejection rate α to the specific area is at least 100% and less than 400%.

The ninth area V9 includes an area in the center of the image formable area V9 which does not curl easily.

By contrast, the first to eighth areas V1 to V8 are areas on the edges of the image formable area V9, and do not include the area in the center of the image formable area V9. Accordingly, the first to eighth areas V1 to V8 generally curl more easily than the ninth area V9.

As a result, the second information Z2 has larger values demarcating ranges of the ink ejection rate α than the first information Z1. Specifically, in the first information Z1, the ranges of the ink ejection rate α to the specific area are demarcated as (a) at least 0% and less than 50%, (b) at least 50% and less than 80%, and (c) at least 80% and less than 400%. By contrast, in the second information Z2, the ranges of the ink ejection rate α to the specific area are demarcated as (d) at least 0% and less than 60%, (e) at least 60% and less than 100%, and (f) at least 100% and less than 400%.

That is, the difference between the ranges of the ink ejection rate α in the second information Z2 and the ranges of the ink ejection rate α in the first information Z1 reflects that the ninth area V9 includes the area in the center of the image formable area V9 that does not curl easily.

The following describes fourth bending information 65 which is a variation of the second bending information 63 (FIG. 7B) with reference to FIG. 12. FIG. 12 is a conceptual diagram illustrating the fourth bending information 65.

The fourth bending information 65 is information set for inkjet paper likewise to the second bending information 63. The fourth bending information 65 differs from the second bending information 63 by the addition of fourth information Z4 for the ninth area V9.

As illustrated in FIG. 12, the fourth bending information 65 indicates the first target bending amount β of the specific area corresponding to the ink ejection rate α (ejection amount of ink) to the specific area in a case where the areas V include the first to ninth areas V1 to V9. The fourth bending information 65 includes two types of information: third information Z3 for the first to eighth areas V1 to V8 and the fourth information Z4 for the ninth area V9. The third information Z3 for the first to eighth areas V1 to V8 is the same as the second bending information 63.

In the fourth information Z4, types of information are set in the same manner as in the second information Z2. In the fourth information Z4, the first target bending amount β of the specific area is set to suit the properties of inkjet paper. By contrast, in the second information Z2, the first target bending amount β of the specific area is set to suit the properties of plain paper. Accordingly, differences may arise when comparing the fourth information Z4 and the second information Z2 in the first target bending amount β under the conditions that the ink ejection rate α and basis weight γ of the sheet S are the same therebetween.

In a case where the areas V include the ninth area V9, the first calculating section 72 calculates an ink ejection rate α for each of the first to ninth areas V1 to V9 in Step S30 (FIG. 8). The second calculating section 73 calculates a second target bending amount of each of the first to ninth areas V1 to V9 in Step S40. The determining section 74 determines a third target bending amount of the sheet S based on the second target bending amounts of the first to ninth areas V1 to V9 in Step S50.

As described above with reference to FIGS. 11 and 12, the areas V include the ninth area V9. Accordingly, the determining section 74 determines the third target bending amount of the sheet S based on the second target bending amounts of the first to ninth areas V1 to V9. That is, the determining section 74 determines the third target bending amount of the sheet S to reflect not only curling in the edges of the image formable area V9 but also curling in the center of the image formable area V9. As a result, the decurler 20 can more effectively reduce curling in the sheet S.

INDUSTRIAL APPLICABILITY

The present invention is applicable in the field of inkjet recording apparatuses which form an image on a sheet.

The invention claimed is:

1. An inkjet recording apparatus comprising:

memory that stores therein bending information in which a plurality of first target bending amounts corresponding to respective ejection amounts are defined, the ejection amounts being amounts of an ink ejected and being different from each other;

a processor connected to the memory;

an image forming section configured to eject the ink onto a sheet; and a bending mechanism including a roller and a belt that hold the sheet therebetween, and configured to bend the sheet by moving a position of a center of the roller toward the belt, wherein the processor calculates for each of areas included in a region of the sheet an amount of the ink ejected to the area, calculates second target bending amounts based on the calculated amounts of the ink ejected to the respective areas of the sheet and the bending information stored in the memory, and determines a third target bending amount of the sheet based on the second target bending amounts, and the processor determines a highest one of the second target bending amounts corresponding to the respective areas as the third target bending amount for bending the sheet by the bending mechanism.

2. The inkjet recording apparatus according to claim 1, wherein the areas include a first area, a second area, a third area, a fourth area, a fifth area, and a sixth area, the first area is, among a plurality of corners of an image formable area of the sheet, an area positioned farthest upstream in a conveyance direction of the sheet and on one side of the sheet in a width direction of the sheet, the width direction is a direction perpendicular to the conveyance direction, the second area is, among the corners, an area positioned farthest upstream in the conveyance direction of the sheet and on another side of the sheet in the width direction, the third area is, among the corners, an area positioned farthest downstream in the conveyance direction of the sheet and on the one side of the sheet in the width direction, the fourth area is, among the corners, an area positioned farthest downstream in the conveyance direction of the sheet and on the other side of the sheet in the width direction, the fifth area is an area of the image formable area along an edge of the image formable area farthest upstream in the conveyance direction, and the sixth area is an area of the image formable area along an edge of the image formable area farthest downstream in the conveyance direction.

3. The inkjet recording apparatus according to claim 2, wherein the areas include a ninth area, and the ninth area is an entirety of the image formable area.

4. The inkjet recording apparatus according to claim 1, wherein the areas include a first area, a second area, a third area, a fourth area, a seventh area, and an eighth area, the first area is, among a plurality of corners of an image formable area of the sheet, an area positioned farthest upstream in a conveyance direction of the sheet and on one side of the sheet in a width direction of the sheet, the width direction is a direction perpendicular to the conveyance direction, the second area is, among the corners, an area positioned farthest upstream in the conveyance direction of the sheet and on another side of the sheet in the width direction, the third area is, among the corners, an area positioned farthest downstream in the conveyance direction of the sheet and on the one side of the sheet in the width direction, the fourth area is, among the corners, an area positioned farthest downstream in the conveyance direction of the sheet and on the other side of the sheet in the width direction, the seventh area is an area of the image formable area along an edge of the one side of the image formable area in the width direction, and the eighth area is an area of the image formable area along an edge of the other side of the image formable area in the width direction.

5. The inkjet recording apparatus according to claim 1, wherein the areas include a first area, a second area, and a fifth area, the first area is, among a plurality of corners of an image formable area of the sheet, an area positioned farthest upstream in a conveyance direction of the sheet and on one side of the sheet in a width direction of the sheet, the width direction is a direction perpendicular to the conveyance direction, the second area is, among the corners, an area positioned farthest upstream in the conveyance direction of the sheet and on another side of the sheet in the width direction, the fifth area is an area of the image formable area along an edge of the image formable area farthest upstream in the conveyance direction.

6. The inkjet recording apparatus according to claim 1, wherein the areas include a first area, a second area, a third area, a fourth area, a fifth area, a sixth area, a seventh area, and an eighth area, the first area is, among a plurality of corners of an image formable area of the sheet, an area positioned farthest upstream in a conveyance direction of the sheet and on one side of the sheet in a width direction of the sheet, the width direction is a direction perpendicular to the conveyance direction, the second area is, among the corners, an area positioned farthest upstream in the conveyance direction of the sheet and on another side of the sheet in the width direction, the third area is, among the corners, an area positioned farthest downstream in the conveyance direction of the sheet and on the one side of the sheet in the width direction, the fourth area is, among the corners, an area positioned farthest downstream in the conveyance direction of the sheet and on the other side of the sheet in the width direction, the fifth area is an area of the image formable area along an edge of the image formable area farthest upstream in the conveyance direction, the sixth area is an area of the image formable area along an edge of the image formable area farthest downstream in the conveyance direction, the seventh area is an area of the image formable area along an edge of the one side of the image formable area in the width direction, and the eighth area is an area of the image formable area along an edge of the other side of the image formable area in the width direction.

7. The inkjet recording apparatus according to claim 1, wherein the bending information indicates the first bending amounts corresponding to the respective ejection amounts for each specific range of basis weight of the sheet.

8. The inkjet recording apparatus according to claim 1, wherein the bending information is provided for each type of the sheet.

* * * * *